US010336057B2

(12) United States Patent
Moore et al.

(10) Patent No.: US 10,336,057 B2
(45) Date of Patent: Jul. 2, 2019

(54) VARIABLE DATA MARKING DIRECT TO PRINT MEDIA

(71) Applicant: XEROX CORPORATION, Norwalk, CT (US)

(72) Inventors: Steven R. Moore, Pittsford, NY (US); Peter J. Knausdorf, Henrietta, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 12 days.

(21) Appl. No.: 15/014,217

(22) Filed: Feb. 3, 2016

(65) Prior Publication Data

US 2017/0217150 A1 Aug. 3, 2017

(51) Int. Cl.

| | |
|---|---|
| ***B41N 3/08*** | (2006.01) |
| ***B41F 7/24*** | (2006.01) |
| ***B41M 1/06*** | (2006.01) |
| ***B41C 1/10*** | (2006.01) |
| ***B41J 2/175*** | (2006.01) |
| ***B41F 7/00*** | (2006.01) |

(52) U.S. Cl.

CPC ..... *B41F 7/24* (2013.01); *B41C 1/1033* (2013.01); *B41F 7/00* (2013.01); *B41J 2/175* (2013.01); *B41M 1/06* (2013.01); *B41N 3/08* (2013.01); *B41C 1/1008* (2013.01); *B41P 2227/70* (2013.01)

(58) Field of Classification Search

None

See application file for complete search history.

(56) References Cited

U.S. PATENT DOCUMENTS

| | | | | |
|---|---|---|---|---|
| 8,869,698 | B2 * | 10/2014 | De Joseph | B41C 1/1066 101/450.1 |
| 2012/0103212 | A1 | 5/2012 | Stowe et al. | |
| 2013/0032050 | A1 * | 2/2013 | Pattekar | G03G 15/10 101/148 |
| 2013/0247787 | A1 * | 9/2013 | Liu | B41C 1/1033 101/147 |

* cited by examiner

*Primary Examiner* — Joshua D Zimmerman

(74) *Attorney, Agent, or Firm* — Caesar Rivise, PC

(57) ABSTRACT

An apparatus and method for printing directly onto print media including smooth non-absorbent media substrates (e.g., polymer films) inks having a wide range in viscosity, so that flexographic, gravure, and lithographic inks can all be contemplated. The proposed method is able to print with variable data/imaging. Dampening fluid may be patterned onto an imaging roll by coating the imaging roll with a layer of the dampening fluid and selectively evaporating off a patterned portion via a laser imaging device. The imaging roll then contacts the print substrate and transfers the patterned dampening fluid onto the substrate via film splitting. The substrate then passes through an inker station where ink is deposited directly to the substrate for attachment thereto except where rejected by the dampening fluid.

19 Claims, 5 Drawing Sheets

VARIABLE DATA MARKING DIRECT TO PRINT MEDIA

BACKGROUND OF THE INVENTION

The disclosure relates to ink-based digital printing. In particular, the disclosure relates to printing variable data directly onto a print substrate that may be smooth and non-absorbent using an ink-based digital printing system that includes dampening fluid and ink.

Ink-based digital printing uses a variable data lithography printing system, or digital offset printing system. A "variable data lithography system" is a system that is configured for lithographic printing using high viscosity lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

The problem of printing high viscosity inks or materials using variable data is a current problem for current marking systems. Current systems such as offset lithography and inkjet marking can either print high viscosity inks or variable data but not both. In conventional offset printing, the printing process may include transferring radiation-curable ink onto a portion of an imaging member surface (plate, drum, or the like) that has been selectively coated with a dampening fluid layer according to invariant image data. The ink is then transferred from the printing plate to a print substrate such as paper, plastic, or metal on which an image is being printed and subsequently cured. However, while conventional offset printing can print medium to high viscosity inks it cannot print variable data. Inkjet marking systems can print variable data but not using medium or high viscosity inks. Further, a digital system containing a blanket or plate will have difficulties providing cleaning systems capable of reliably and safely removing residual ink from a reimageable surface of the blanket or plate without affecting its longevity. These challenges need to be met in order for variable data lithography printing systems to work efficiently for a wide range of paper media and inks.

As such, there is a need to overcome the deficiencies of conventional printing technology for printing variable data with a wide range of inks and print substrates. There is also a need in the art for a printing process that can print inks of various viscosities directly to the print substrate with variable image data.

BRIEF SUMMARY OF THE INVENTION

Accordingly, an exemplary improved apparatus and method prints directly onto print substrates, for example, smooth or non-absorbent media substrates such as polymer films using a method that is capable of using medium to high viscosity marking materials (e.g., ink, pigmented conductive fluid, toner), hereinafter also referred to as ink, including those needed for printed electronics. The exemplary apparatus and method allow for printing with variable data/imaging. While not being limited to a particular theory, a layer of dampening fluid, which is a substance that alters the frictional coefficient of a surface, (e.g., silicone oil) is patterned onto an imaging member (e.g., roll, drum, blanket) as a latent image. The imaging member contacts the substrate and the patterned latent image of dampening fluid is transferred onto the substrate via film splitting. The substrate then passes through an inker station or subsystem where ink is deposited directly onto the substrate except where rejected by the transferred dampening fluid to form a print image. Accordingly, ink is deposited directly from the inker station to the substrate, without the imaging member as an intermediate unit. Thus, the imaging member may not receive or transfer ink. This eliminates the need for a conformable ink-receptive imaging member and for an ink cleaning station, in particular, an ink cleaning station in communication with an imaging member. The exemplary approach also enables a true digital alternative to flexographic and roto-gravure printing onto polymers, for example, for packaging applications, non-absorbent surface applications, printed electronics, etc.

According to aspects illustrated herein, there is provided an apparatus for printing directly onto a print substrate in a variable data lithography system, including an imaging member, a latent image transfer subsystem, and an inker subsystem. The imaging member has a reimageable imaging member surface configured to receive a patterned latent image of dampening fluid thereon. The latent image transfer subsystem includes the imaging member and a backer, with the latent image transfer subsystem configured to transfer the patterned latent image of dampening fluid from the reimageable imaging member surface to the print substrate at a first nip in a print substrate media direction within the latent image transfer subsystem. The inker subsystem is downstream of the imaging member in the media direction, with the inker subsystem configured to apply ink from the inker subsystem directly to the print substrate having the patterned latent image of dampening fluid disposed thereon, the ink adhering to portions of the print substrate absent the dampening fluid solution resulting in an inked image on the print substrate.

The apparatus for printing directly onto a print substrate in a variable data lithography system may include a dampening fluid subsystem configured to apply a layer of dampening fluid to the reimageable imaging member surface, and a patterning device configured to selectively remove portions of the dampening fluid layer to produce the patterned latent image of the dampening fluid on the reimageable imaging member surface. In the apparatus, both the imaging member and the inker substation may be in fluid communication with a first side of the print substrate. In the apparatus, the reimageable imaging member surface may be rigid or have a limited compliance. The apparatus may also include vapor removal apparatus adjacent the imaging member that is configured to remove dampening fluid vapor adjacent the imaging member and to recycle the dampening fluid to the dampening fluid subsystem.

The exemplary embodiments may include a method for printing directly onto a print substrate in a variable data lithography system. The method may include receiving a patterned latent image of dampening fluid on a reimageable imaging member surface of an imaging member, transferring the patterned latent image of dampening fluid from the reimageable imaging member surface to the print substrate at a first nip in a print substrate media direction within a latent image transfer subsystem including the imaging member and a backer, and applying ink from an inker subsystem located downstream of the imaging member in the media direction directly to the print substrate having the patterned latent image of dampening fluid disposed thereon, the ink adhering to portions of the print substrate absent the dampening fluid solution resulting in an inked image on the print substrate.

The method may also include applying a layer of dampening fluid to the reimageable imaging member surface with a dampening fluid subsystem, and removing select portions of the dampening fluid layer with a patterning device to produce the patterned latent image of the dampening fluid on the reimageable imaging member surface. The method may further include using an imaging member with a rigid outer surface to transfer the patterned latent image of dampening fluid, and using an anilox inker roll with a rigid outer surface to meter the ink onto the print substrate. The method may yet further include removing dampening fluid vapor adjacent the imaging member with a vapor removal apparatus adjacent the patterning device.

According to aspects illustrated herein, a print strategy includes a variable data lithography system useful in printing including an imaging member, a latent image transfer subsystem, an inker subsystem, a processor, and a storage device. The imaging member has a reimageable imaging member surface configured to receive a patterned latent image of dampening fluid thereon. The latent image transfer subsystem includes the imaging member and a backer, with the latent image transfer subsystem configured to transfer the patterned latent image of dampening fluid from the reimageable imaging member surface to the print substrate at a first nip in a print substrate media direction within the latent image transfer subsystem. The inker subsystem is downstream of the imaging member in the media direction, with the inker subsystem configured to apply ink from the inker subsystem directly to the print substrate having the patterned latent image of dampening fluid disposed thereon, the ink adhering to portions of the print substrate absent the dampening fluid solution resulting in an inked image on the print substrate. The storage device is coupled to the processor and contains instructions operative on the processor for providing the patterned latent image of dampening fluid onto the reimageable imaging member surface, transferring the patterned latent image of dampening fluid from the reimageable imaging member surface to the print substrate, and applying ink from the inker subsystem directly to the print substrate resulting in the inked image on the print substrate.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
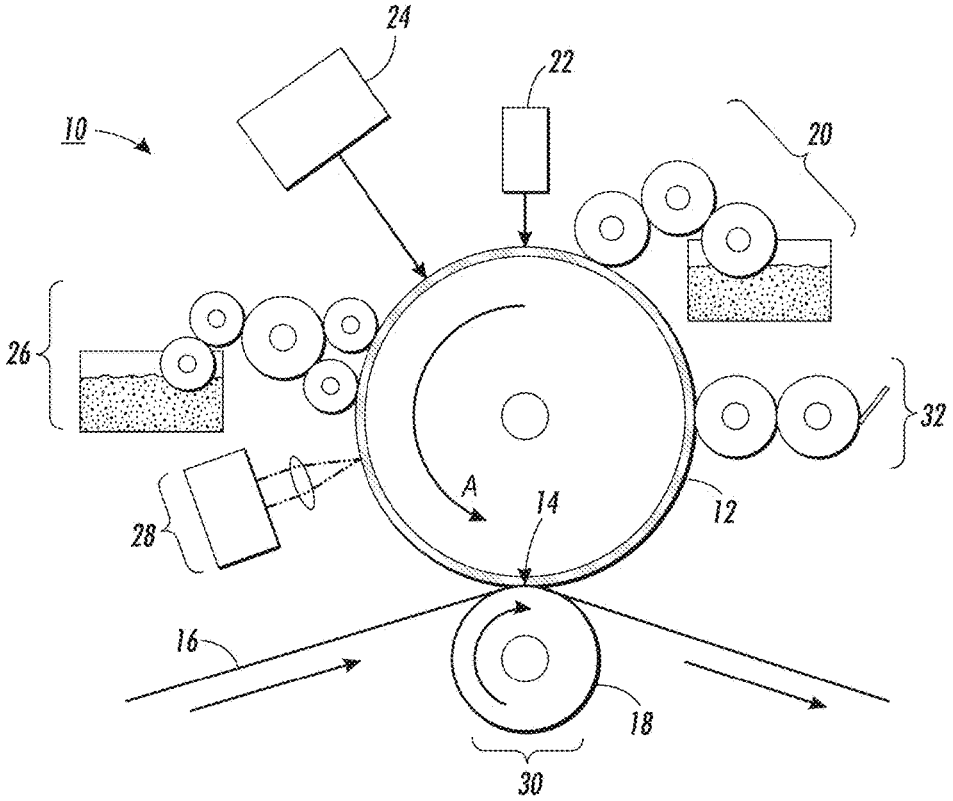
FIG. 1 RELATED ART
FIG. 1 is a side view of a related art variable data lithography system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Although embodiments of the invention are not limited in this regard, discussions utilizing terms such as, for example, "processing", "computing", "calculating", "determining", "applying", "receiving", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "controller" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "print media", "print substrate" and "print sheet" generally refers to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

As used herein, an "electromagnetic receptor" or "electromagnetic absorbent" is a material which will interact with electromagnetic energy to dissipate the energy such as heat. The applied electromagnetic energy could be used to trigger thermal losses at the receptor through a combination of loss mechanisms.

For illustrative purposes, although the term "fixing apparatus" is used herein throughout the application, it is intended that the term "fixing apparatus" also encompasses members useful for a printing process or in a printing system including, but not limited to, a fixing member, a pressure member, UV curing member, an Electron Beam curing member, a heat member, and/or a donor member. In various embodiments, the fixing apparatus can be in a form of, for example, a roller, a cylinder, a belt, a plate, a film, a sheet, a drum, a drelt (cross between a belt and a drum), or other known form for a fixing apparatus. A "fixing apparatus" as described herein may be adapted to be useful in other types of printing, such as solid-inkjet printing, iconography, xerography, flexography, offset printing, and the like.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

A related art variable data lithography printing system is disclosed in U.S. Patent Application Publication No. 2012/0103212 A1 (the 212 Publication) published May 3, 2012, and based on U.S. patent application Ser. No. 13/095,714, which is commonly assigned. The 212 Publication describes an exemplary variable data lithography system 10 such as that shown, for example, in FIG. 1. A general description of the exemplary system 10 shown in FIG. 1 is provided here. Additional details regarding individual components and/or subsystems shown in the exemplary system 10 of FIG. 1 may be found in the 212 Publication.

As shown in FIG. 1, the exemplary system 10 may include an imaging member 12 used to apply an inked image to a target image receiving media substrate 16 at a transfer nip 14. The transfer nip 14 is produced by an impression roller 18, as part of an image transfer mechanism 30, exerting pressure in the direction of the imaging member 12.

The exemplary system 10 may be used for producing images on a wide variety of image receiving media substrates 16. The 212 Publication explains the wide latitude of marking (printing) materials that may be used, including marking materials with pigment densities greater than 10% by weight. Increasing densities of the pigment materials suspended in solution to produce different color inks is generally understood to result in increased image quality and vibrancy. These increased densities, however, often result in precluding the use of such inks in certain image forming applications that are conventionally used to facilitate variable data digital image forming, including, for example, jetted ink image forming applications.

As noted above, the imaging member 12 may be comprised of a reimageable surface layer or plate formed over a structural mounting layer that may be, for example, a cylindrical core, or one or more structural layers over a cylindrical core. A dampening fluid subsystem 20 may be provided generally comprising a series of rollers, which may be considered as dampening rollers or a dampening unit, for uniformly wetting the reimageable plate surface with a layer of dampening fluid or fountain solution, generally having a uniform thickness, to the reimageable plate surface of the imaging member 12. Once the dampening fluid or fountain solution is metered onto the reimageable surface, a thickness of the layer of dampening fluid or fountain solution may be measured using a sensor 22 that provides feedback to control the metering of the dampening fluid or fountain solution onto the reimageable plate surface.

An optical patterning subsystem 24 may be used to selectively form a latent image in the uniform dampening fluid layer by image-wise patterning the dampening fluid layer using, for example, laser energy. It is advantageous to form the reimageable plate surface of the imaging member 12 from materials that should ideally absorb most of the IR or laser energy emitted from the optical patterning subsystem 24 close to the reimageable plate surface. Forming the plate surface of such materials may advantageously aid in substantially minimizing energy wasted in heating the dampening fluid and coincidentally minimizing lateral spreading of heat in order to maintain a high spatial resolution capability. The mechanics at work in the patterning process undertaken by the optical patterning subsystem 24 of the exemplary system 10 are described in detail with reference to FIG. 5 in the 212 Publication. Briefly, the application of optical patterning energy from the optical patterning subsystem 24 results in selective evaporation of portions of the uniform layer of dampening fluid in a manner that produces a latent image.

The patterned layer of dampening fluid having a latent image over the reimageable plate surface of the imaging member 12 is then presented or introduced to an inker subsystem 26. The inker subsystem 26 is usable to apply a uniform layer of ink over the patterned layer of dampening fluid and the reimageable plate surface of the imaging member 12. In embodiments, the inker subsystem 26 may use an anilox roller to meter an ink onto one or more ink forming rollers that are in contact with the reimageable plate surface of the imaging member 12. In other embodiments, the inker subsystem 26 may include other traditional elements such as a series of metering rollers to provide a precise feed rate of ink to the reimageable plate surface. The inker subsystem 26 may deposit the ink to the areas representing the imaged portions of the reimageable plate surface, while ink deposited on the non-imaged portions of the dampening fluid layer will not adhere to those portions.

Cohesiveness and viscosity of the ink residing on the reimageable plate surface may be modified by a number of mechanisms, including through the use of some manner of rheology control subsystem 28. In embodiments, the rheology control subsystem 28 may form a partial crosslinking core of the ink on the reimageable plate surface to, for example, increase ink cohesive strength relative to an adhesive strength of the ink to the reimageable plate surface. In embodiments, certain curing mechanisms may be employed. These curing mechanisms may include, for example, optical or photo curing, heat curing, drying, or various forms of chemical curing. Cooling may be used to modify rheology of the transferred ink as well via multiple physical, mechanical or chemical cooling mechanisms.

Substrate marking occurs as the ink is transferred from the reimageable plate surface to a substrate of image receiving media 16 using the transfer subsystem 30. With the adhesion and/or cohesion of the ink having been modified by the rheology control system 28, modified adhesion and/or cohesion of the ink causes the ink to transfer substantially completely preferentially adhering to the substrate 16 as it separates from the reimageable plate surface of the imaging member 12 at the transfer nip 14. Careful control of the temperature and pressure conditions at the transfer nip 14, combined with reality adjustment of the ink, may allow transfer efficiencies for the ink from the reimageable plate surface of the imaging member 12 to the substrate 16 to exceed 95%. While it is possible that some dampening fluid may also wet substrate 16, the volume of such transferred dampening fluid will generally be minimal so as to rapidly evaporate or otherwise be absorbed by the substrate 16.

Finally, a cleaning system 32 is provided to remove residual products, including non-transferred residual ink and/or remaining dampening fluid from the reimageable plate surface in a manner that is intended to prepare and condition the reimageable plate surface of the imaging member 12 to repeat the above cycle for image transfer in a variable digital data image forming operations in the exemplary system 10. An air knife may be employed to remove residual dampening fluid. It is anticipated, however, that some amount of ink residue may remain. Removal of such remaining ink residue may be accomplished through use by some form of cleaning subsystem 32. The 212 Publication describes details of such a cleaning subsystem 32 including at least a first cleaning member such as a sticky or tacky member in physical contact with the reimageable surface of the imaging member 12, the sticky or tacky member removing residual ink and any remaining small amounts of surfactant compounds from the dampening fluid of the reimageable surface of the imaging member 12. The sticky or tacky member may then be brought into contact with a smooth roller to which residual ink may be transferred from the sticky or tacky member, the ink being subsequently stripped from the smooth roller by, for example, a doctor blade.

The 212 Publication details other mechanisms by which cleaning of the reimageable surface of the imaging member 12 may be facilitated. Regardless of the cleaning mechanism, however, cleaning of the residual ink and dampening fluid from the reimageable surface of the imaging member 12 is essential to prevent a residual image from being printed in the proposed system. Once cleaned, the reimageable surface of the imaging member 12 is again presented to the dampening fluid subsystem 20 by which a fresh layer of dampening fluid is supplied to the reimageable surface of the imaging member 12, and the process is repeated.

Figure 2:
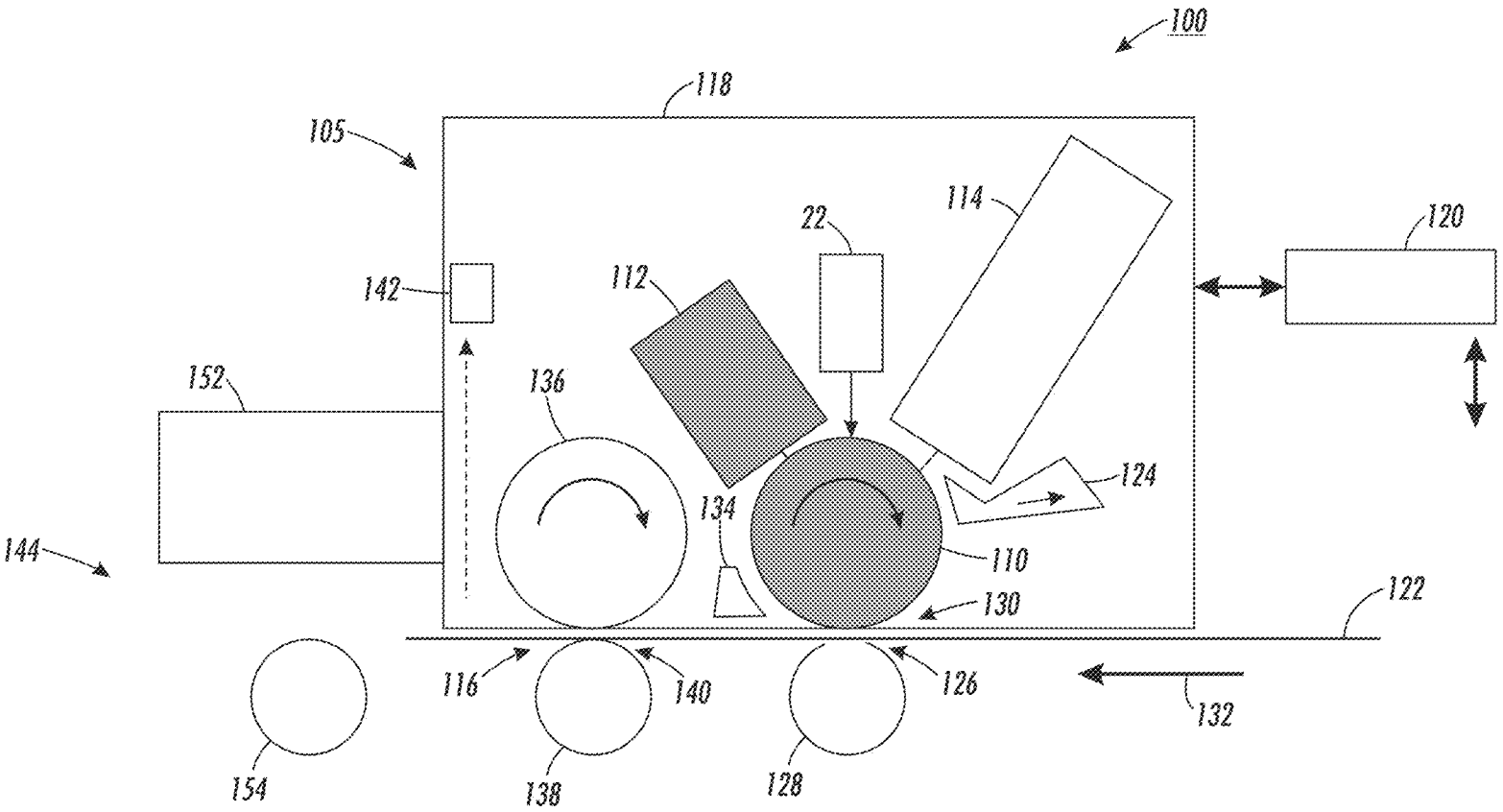
FIG. 2 is a side diagrammatical view of a variable data lithography system printing directly onto a print substrate in accordance with an exemplary embodiment.

FIG. 2 depicts a simplified layout of an exemplary variable data lithography system 100 according to embodiments of the invention. As shown in FIG. 2, an exemplary variable data lithography system 100 may include one or more print stations 105 having an imaging member 110, a dampening fluid subsystem 112, a patterning subsystem 114, and an inker subsystem 116. The system 100 may, at least in part, be enclosed within an infrared radiation (IR)-tight housing 118.

The imaging member 110 may be an electromagnetic receptor shown in FIG. 2 as a drum. Although depicted as a drum, the imaging member 110 should not be interpreted as necessarily restricted to a drum or drum-type imaging member, as it may include, for example, a drum, plate or a belt, or another now known or later developed configuration. The imaging member 110 includes an outer surface, which is a reimageable imaging member surface that may be rigid or have a limited compliance. The outer surface may be an elastomer such as silicone rubber having a high carbon black concentration to absorb laser energy.

A controller 120 is shown and it is capable of receiving information and instructions from a workstation and from image input devices to coordinate the image formation on a print substrate 122 through the various subsystems such as the dampening fluid subsystem 112, the patterning subsystem 114, the inker subsystem 116, and the like. The print substrate 122 should not be considered to be limited to any particular composition such as, for example, paper, plastic, or composite sheet film. The exemplary system 100 may be used for producing images on a wide variety of image receiving print or media substrates.

The dampening fluid subsystem 112 delivers a layer of dampening fluid, generally having a uniform and controlled thickness, on the outer surface of the imaging member 110. The dampening fluid is a fluid solution that may be applied via direct contact or in an airborne state such as by steam, atomized fluid, nebulized fluid, or otherwise made to be in particulate form and airborne for the purpose of transporting same by way of a gas flow. The dampening fluid may be non-aqueous including, for example, silicone fluids (such as D3, D4, D5, OS10, OS20 and the like), and polyfluorinated ether or fluorinated silicone fluid. The outer surface of the imaging member 110 may be tailored to the specific dampening fluid applied by the dampening fluid subsystem 112.

The dampening fluid may also be a water or aqueous-based fountain solution which is generally applied by direct contact with the reimageable imaging member surface of the imaging member 110 through, for example, a series of rollers for uniformly wetting the imaging member with the dampening fluid. The fluid solution or a dampening fluid may comprise mainly water that is optionally combined with small amounts of isopropyl alcohol or ethanol to reduce surface tension as well as to lower evaporation energy necessary to support subsequent laser patterning, as will be described in greater detail below. Small amounts of certain surfactants may be added to the dampening fluid as well. Alternatively, other suitable dampening fluids may be used to enhance the performance of ink based digital lithography systems. Exemplary dampening fluids may include water and mixtures of the Novec™ solvents.

Once the dampening fluid is applied onto the imaging member 110, a thickness of the dampening fluid may be measured using a sensor 22 [Sensor 22 not shown in FIG. 2] that provides feedback to control (e.g., via controller 120) the metering of the dampening fluid onto the reimageable imaging member surface of the imaging member 110 by the dampening fluid subsystem 112.

After a precise and uniform amount of dampening fluid is provided by the dampening fluid subsystem 112 on the imaging member 110 to form a dampening fluid layer, an optical patterning subsystem 114 may be used to selectively remove portions of the dampening fluid layer and form a latent image in the uniform dampening fluid layer by image-wise patterning the dampening fluid layer using, for example, laser energy or optical energy in the infrared (IR) wavelengths of the electromagnetic spectrum.

The outer surface of the imaging member 110 should ideally absorb most of the laser energy (visible or invisible such as IR) emitted from the optical patterning subsystem 114 close to the surface to minimize energy wasted in heating the dampening fluid and to minimize lateral spreading of heat in order to maintain a high spatial resolution capability. An appropriate radiation sensitive component may be added to the dampening fluid to aid in the absorption of the incident radiant laser energy at the imaging member 110. While the optical patterning subsystem 114 is described in this example as including a laser emitter, it should be understood that a variety of different systems may be used to deliver the optical energy to pattern the dampening fluid on the reimageable imaging member surface.

The absorption of the laser energy from the optical patterning subsystem 114 by the imaging member 110 causes the dampening fluid to evaporate away only at the point spot of the laser. The line of laser light can be turned on and off in segments or points of light which form the resolution of the process. Airborne evaporated dampening fluid may be collected at a point immediately after evaporation so as to prevent recondensing of the solution. In this example, a vapor collection manifold 124 adjacent to the optical patterning subsystem 114 removes vaporized evaporated dampening fluid before it can recondense onto the patterned latent image or a print substrate 122.

The imaging member 110 is used to apply the patterned latent image of dampening fluid to a print substrate 122 at a transfer nip 126. The transfer nip 126 may be produced by a backer roller 128, as part of a latent image transfer subsystem 130 that exerts pressure in the direction of the imaging member 110. The patterned latent image of dampening fluid on the imaging member 110 rotates and, at the transfer nip 126, contacts the print substrate 122 depicted transported along a media direction 132 from right to left in a continuous manner without stopping. Sufficient pressure and nip conformity are applied so that the patterned dampening fluid is transferred onto the print substrate 122. As the print substrate 122 exits the transfer nip, the patterned dampening fluid layer splits with a patterned dampening fluid film thereof (e.g., about half or more of the dampening fluid layer thickness) transferring to the print substrate. Residual dampening fluid remaining on the imaging member 110 may be evaporated and reclaimed for reuse, for example, by a vapor collection manifold 134 after the transfer nip 126 so as to prevent recondensing of the evaporated dampening fluid solution onto the print substrate 122. The vapor collection manifold 134 may be integral with the vapor collection manifold 124, with either or both manifolds extending to the dampening fluid subsystem 112 for reuse.

The print substrate 122 continues along the media direction 132 and enters the inker subsystem 116 where ink is deposited onto the print substrate wherever the dampening fluid does not reject it. The exemplary inker subsystem 116 includes an inker roll 136 and a backer roll 138, which may be compliant as needed to support the print substrate 122 at the nip 140 formed between the inker roll and the backer roll. The inker roll 136 is shown as a single roll, but may be a plurality of rollers, including an anilox roller to meter lithographic ink onto the print substrate 114. Separately, the inker subsystem 116 may include other traditional elements such as a series of metering rollers to provide a precise feed rate of ink to the print substrate 114. The inker subsystem 116 may deposit the ink to pockets representing the formatted imaged portions of the print substrate 122, while ink on the unformatted portions of the print substrate having dampening fluid thereon will not adhere to those portions. The ink can have a wide range in viscosity, so that flexographic, gravure, and lithographic inks can all be used.

After the print substrate 122 exits the inker subsystem 116, residual dampening fluid remaining on the substrate can be evaporated, for example by a vapor collection manifold 142, and optionally reclaimed to the dampening fluid subsystem 112. Residual dampening fluid may also be removed using known cleaning methods and solutions. For example, an air knife may be employed to remove residual dampening fluid.

After inking, the inked/print substrate 122 may be moved in the media direction 132 to a fixing subsystem 144 with a fixing mechanism that may include optical or photo curing, heat curing, drying, or various forms of chemical curing. While not being limited to a particular theory, the fixing mechanism is shown having a UV LED lamp 152. The fixing subsystem 144 may also include a support backer 154 (e.g., backer roll) as needed to support the print substrate through interaction with the fixing mechanism.

Following the inker and optional fixing subsystem 144, the inked/print substrate 122 may continue to another print station 105 for application of an ink of a different type (e.g., color, viscosity, pigment), to a transport handling mechanism such as a belt or gripper apparatus that serves to deliver single sheets, part of a roll of paper, or bundles of sheets after inking to a finishing station, an output tray, or to another fixing apparatus like the fixing subsystem 144.

One example of the system shown in FIG. 2 includes a fully digital 'patch generator' onto a print substrate. For instance, a patch of white ink, or another color ink, can be applied to a print substrate 122 by a print station 105 upstream of a subsequent print station. This provides the advantages of using a flexographic or roto-gravure type white ink in a fully digital print system. Compared to an ink jet ink, flexographic and roto-gravure type white inks have higher pigment loading and, thus, can provide opacity and reflectivity at much thinner ink film thicknesses. As another example, the patch of white ink, or another color ink, could be applied to a print substrate by an analog printing press upstream of a print station 105.

Figure 3:
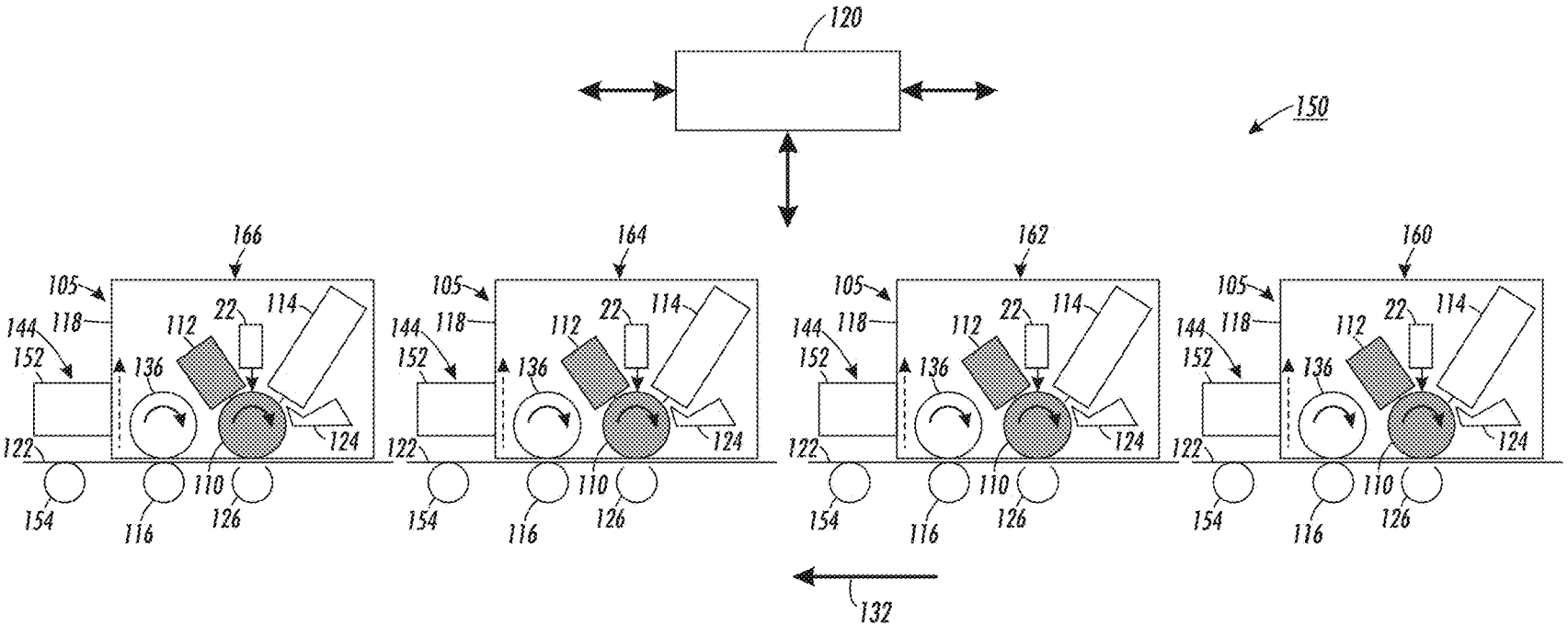
FIG. 3 is a side diagrammatical view of a variable data lithography system having a plurality of print stations printing directly onto a print substrate in accordance with an exemplary embodiment.

FIG. 3 depicts a variable data lithography system 150 having a plurality of print stations 105 in series as a first print station 160, a second print station 162, a third print station 164, and a fourth print station 166. In this example, each print station 105 applies a different ink type (e.g., color, viscosity, pigment), such as a respective color ink image portion, to a print substrate 122 traveling along the media direction 132. For example, each of the print stations 105 applies a different respective color ink of cyan, magenta, yellow and key (black); abbreviated as CMYK. As another example, the first print station 160 may apply a patch of white ink, or another color ink, and the second, third and fourth print stations 162, 164, 166 may each apply a different respective color ink image portion of CMYK to the print substrate 122. Of course a fifth print station 105 may be added to apply the remaining color to the print substrate as needed.

Obviously the variable data lithography systems exemplified herein are scalable systems, so more or fewer ink type separations are feasible. This proposal allows for each respective ink type (e.g., color, viscosity, pigment) image portion to be partially or fully cured prior to an application of a subsequent type of ink image portion in order to avoid any retransfer or interference between ink types. It is understood that if a matched ink set is used, for example, one with progressively high ink viscosities between respective color ink image portions, then inter-color curing may not be required.

Figure 4:
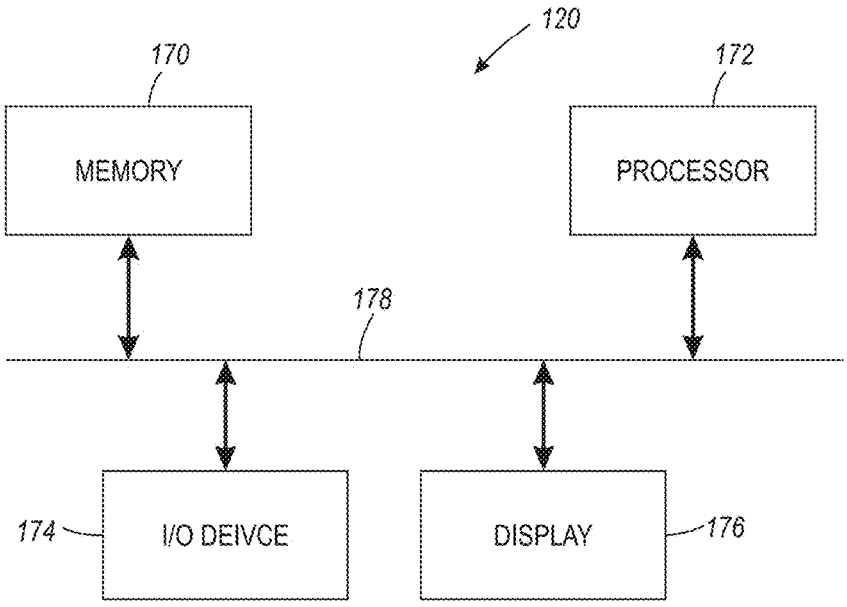
FIG. 4 illustrates a block diagram of a controller with a processor for executing instructions to automatically control devices in the variable data lithography system illustrated in FIG. 2 or 3.

FIG. 4 illustrates a block diagram of a controller 120 with a processor for executing instructions to automatically control devices in the systems illustrated in FIGS. 2 and 3. The controller 120 may be embodied within devices such as a desktop computer, a laptop computer, a handheld computer, an embedded processor, a handheld communication device, or another type of computing device, or the like. The controller 120 may include a memory 170, a processor 172, input/output devices 174, a display 176 and a bus 178. The bus 178 may permit communication and transfer of signals among the components of the controller 120 or computing device.

Processor 172 may include at least one conventional processor or microprocessor that interprets and executes instructions. The processor 172 may be a general purpose processor or a special purpose integrated circuit, such as an ASIC, and may include more than one processor section. Additionally, the controller 120 may include a plurality of processors 172.

Memory 170 may be a random access memory (RAM) or another type of dynamic storage device that stores information and instructions for execution by processor 172. Memory 170 may also include a read-only memory (ROM) which may include a conventional ROM device or another type of static storage device that stores static information and instructions for processor 172. The memory 170 may be any memory device that stores data for use by controller 120.

Input/output devices 174 (I/O devices) may include one or more conventional input mechanisms that permit data between components of the variable data lithography system 100, 150 and for a user to input information to the controller 120, such as a microphone, touchpad, keypad, keyboard, mouse, pen, stylus, voice recognition device, buttons, and the like, and output mechanisms for generating commands, voltages to power actuators, motors, and the like or information to a user such as one or more conventional mechanisms that output information to the user, including a display, one or more speakers, a storage medium, such as a memory, magnetic or optical disk, disk drive, a printer device, and the like, and/or interfaces for the above. The display 176 may typically be an LCD or CRT display as used on many conventional computing devices, or any other type of display device.

The controller 120 may perform functions in response to processor 172 by executing sequences of instructions or instruction sets contained in a computer-readable medium with readable program code, such as, for example, memory 170. Such instructions may be read into memory 170 from another computer-readable medium, such as a storage device, or from a separate device via a communication interface, or may be downloaded from an external source such as the Internet. The controller 120 may be a stand-alone controller, such as a personal computer, or may be connected to a network such as an intranet, the Internet, and the like. Other elements may be included with the controller 120 as needed.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages like Perl or Python. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The memory 170 may store instructions that may be executed by the processor to perform various functions. For example, the memory 170 may store instructions operative on the processor 172 for controlling the activity of the print stations 105, including applying a layer of dampening fluid to the reimageable imaging member surface of the imaging member 110, selectively removing portions of the dampening fluid layer to produce the patterned latent image of the dampening fluid on the reimageable imaging member surface, transferring the patterned latent image of dampening fluid from the reimageable imaging member surface to the print substrate 122, and applying ink from the inker subsystem 116 directly to the print substrate resulting in the inked image on the print substrate.

Figure 5:
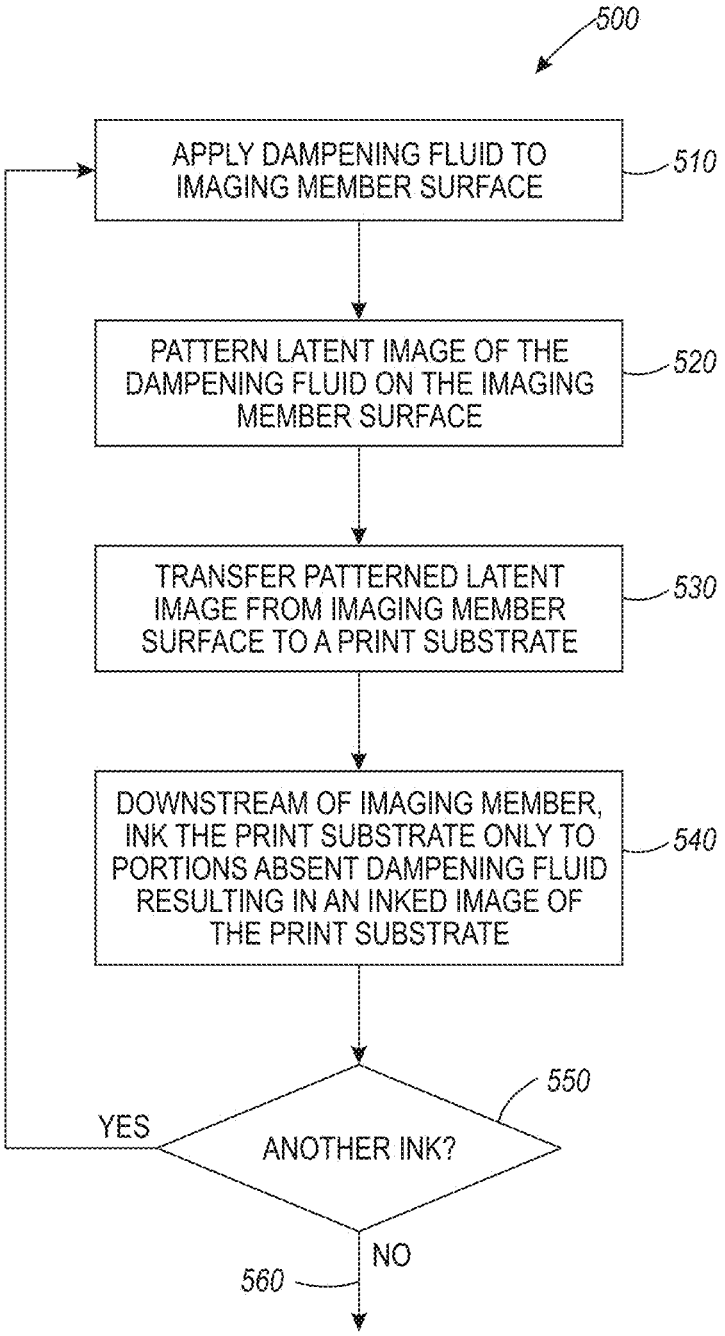
FIG. 5 is a flowchart of a process for printing directly onto a print substrate according to exemplary embodiments.

FIG. 5 is a flowchart of a process for printing directly onto a print media in accordance to exemplary embodiments. The process 500 begins with Step 510 with the dampening fluid subsystem applying a layer of dampening fluid via a dampening fluid subsystem to a reimageable surface of an imaging member. In Step 520, a patterning subsystem then removes select portions of the dampening fluid layer from the imaging member through evaporation to produce the patterned latent image of the dampening fluid on the reimageable imaging member surface. Steps 510 and 520 result in the imaging member receiving a patterned latent image of dampening fluid on a reimageable imaging member surface thereof.

In Step 530, the imaging member transfers the patterned latent image of dampening fluid from the reimageable imaging member surface to the print substrate moving in a print substrate media direction at a first nip within a latent image transfer subsystem including the imaging member and a backer. In Step 540, downstream of the imaging member in the media direction, the inker subsystem applies ink directly to the print substrate having the patterned latent image of dampening fluid disposed thereon, the ink adheres to portions of the print substrate absent the dampening fluid solution where the dampening fluid has been evaporated away from the imaging member resulting in an inked image on the print substrate. In Step 550, a determination is made if another ink type should be added to the inked image. When it is determined that another ink type should be added, then Steps 510-540 are repeated until the inked image is complete. If the determination at Step 550 is that the inked image is complete, then at Step 560 the print substrate with the inked image is forwarded to a transport handling or fixing apparatus. The described process (500) directly inks the print media 114 without the need for ink cleaners to clean the imaging member 110 for a next image.

It should be noted that due to the patterned dampening fluid layer splitting at the transfer nip 126, a dampening fluid layer thicker than the layer preferred in the related art example depicted in FIG. 1 may be desired to ensure the patterned dampening fluid film transferred to the print substrate 122 has a thickness (e.g., about 1 micron) sufficient to reject ink. Fortunately the print substrate 122 is not required to be compatible with laser or IR emissions from the patterning subsystem 114, as such a requirement may limit the substrates available for use with the exemplary print stations 105. Also, the print substrate 122 is not required to be compatible with the dampening fluid subsystem 112, as such a requirement may limit the substrates and dampening fluids available for use with the exemplary print stations 105. Further, the print substrate 122 is not required to conform to the shape of the imaging member 110, as the print substrate and imaging member are in contact only at the transfer nip 126.

In addition, the imaging member 112 has fewer requirements and critical functions to satisfy since the imaging member 112 does not receive or transfer ink. Related systems incorporate dampening fluid application, inking and release from a low surface energy imaging member surface. Inking & releasing are two conflicting functional properties and the design space is limited. Without the ink-releasing/transfer constraints, inks useable in the exemplary variable data lithography systems can be designed to flow better than current inks limited to related systems, therefore providing better solid fill.

Further, the exemplary variable data lithography systems have significant advantages over ink jet for printing onto plastic media due to the different inks that can be used. For example, the exemplary variable data lithography systems can use inks with viscosities in the range of 500-100,000+ cP whereas ink jet requires viscosities of 10 cP or lower. The use of higher viscosity inks brings several functional advantages for packaging applications and ink usage. Thinner ink layers—about 10 times thinner than ink jet—reduces run cost. Higher molecular weight ink components adhere better and migrate less on polymer substrates. Also, the exemplary variable data lithography systems allow greater design flexibility in inks since there is no jetting requirement.

Although the above description may contain specific details, they should not be construed as limiting the claims in any way. Other configurations of the described embodiments of the disclosed systems and methods are part of the scope of this disclosure. For example, the principles of the disclosure may be applied to each individual print station of a plurality of print stations where individual variable data lithography system or groups of the variable data lithography system have associated with them device management applications for communication with a plurality of users or print job ordering sources. Each print station may include some portion of the disclosed variable data lithography system and execute some portion of the disclosed method but not necessarily all of the system components or method steps.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus for printing directly onto a smooth non-absorbent print substrate in a variable data lithography system, comprising:

an imaging member having a rigid inflexible reimageable imaging member surface configured to receive a patterned latent image of dampening fluid thereon;

a latent image transfer subsystem including the imaging member and a backer, the latent image transfer subsystem configured to split a thinned layer of the patterned latent image of dampening fluid from the patterned latent image of dampening fluid and transfer the thinned layer of the patterned latent image of dampening fluid from the rigid inflexible reimageable imaging member surface to the smooth non-absorbent print substrate at a first nip in a print substrate media direction within the latent image transfer subsystem, the imaging member having an imaging roll with the rigid inflexible reimageable imaging member surface, the imaging roll configured to rotate along a longitudinal axis thereof in a first direction to transfer the thinned layer of the patterned latent image from the rigid inflexible reimageable imaging member surface directly onto the smooth non-absorbent print substrate;

an inker subsystem downstream of the imaging member in the media direction, the inker subsystem configured to apply ink from the inker subsystem directly to the smooth non-absorbent print substrate having the thinned layer of the patterned latent image of dampening fluid disposed thereon, the inker subsystem having an inker roll clear of contact with the imaging member, the inker roll configured to rotate along a longitudinal axis thereof in the first direction to transfer the ink directly to the smooth non-absorbent print substrate, the ink adhering to portions of the smooth non-absorbent print substrate absent the dampening fluid solution resulting in an inked image on the smooth non-absorbent print substrate; and a vapor removal apparatus including a first vapor collection manifold adjacent the imaging roll at a first side of the first nip upstream the first nip in the first direction, the vapor removal device configured to remove dampening fluid vapor adjacent the imaging member prior to the first nip, the vapor removal apparatus further including a second vapor collection manifold adjacent the imaging roll downstream the first nip in the first direction, the second vapor collection manifold configured to reclaim dampening fluid vapor evaporated from the imaging member after transfer of the thinned layer of the patterned latent image of dampening fluid from the rigid inflexible reimageable imaging member surface to the smooth non-absorbent print substrate.

2. The apparatus of claim 1, further comprising:

a dampening fluid subsystem configured to apply a layer of dampening fluid to the rigid inflexible reimageable imaging member surface; and a patterning device configured to selectively evaporate portions of the dampening fluid layer by heating the rigid inflexible reimageable imaging member surface under the dampening fluid layer to produce the patterned latent image of the dampening fluid on the rigid inflexible reimageable imaging member surface.

3. The apparatus of claim 1, wherein the smooth non-absorbent print substrate has a first side and a second side, the first side receiving the thinned layer of the patterned latent image of dampening fluid from the imaging member and the ink from the inker subsystem, both the imaging member and the inker substation being in fluid communication with the first side of the smooth non-absorbent print substrate.

4. The apparatus of claim 1, wherein the inker roll is an anilox inker roll having a rigid outer surface, the anilox inker roll configured to meter the ink directly onto the smooth non-absorbent print substrate, and the inker subsystem includes a backer in communication with the second side of the smooth non-absorbent print substrate opposite the anilox inker roll.

5. The apparatus of claim 2, wherein the first vapor collection manifold is adjacent the patterning device.

6. The apparatus of claim 1, the vapor removal apparatus further including a third vapor collection manifold downstream of the inker subsystem, the third vapor collection manifold configured to reclaim dampening fluid from the smooth non-absorbent print substrate through evaporation.

7. The apparatus of claim 2, further comprising an IR-tight housing enclosing the imaging member, the dampening fluid subsystem, the patterning device, the inker roll, and the vapor removal apparatus.

8. The apparatus of claim 1, further comprising a curing subsystem located downstream the inker subsystem in the media direction, the curing subsystem configured to at least partially cure the inked image to the smooth non-absorbent print substrate.

9. The apparatus of claim 1, wherein the print substrate is a polymer film.

10. A method for printing directly onto a smooth non-absorbent print substrate in a variable data lithography system, comprising:

a) receiving a patterned latent image of dampening fluid on a rigid inflexible reimageable imaging member surface of an imaging member;

a') removing dampening fluid vapor adjacent the rigid inflexible reimageable imaging member surface with a first vapor collection manifold adjacent an imaging roll at a first side of a first nip upstream the first nip in a first direction;

a") splitting a thinned layer of the patterned latent image of dampening fluid from the patterned latent image of dampening fluid;

b) transferring the thinned layer of the patterned latent image of dampening fluid from the rigid inflexible reimageable imaging member surface to the smooth non-absorbent print substrate at the first nip in a print substrate media direction within a latent image transfer subsystem including the imaging member and a backer, the imaging member having the imaging roll with the rigid inflexible reimageable imaging member surface, the transferring including rotating the imaging roll along a longitudinal axis thereof in the first direction to transfer the thinned layer of the patterned latent image from the rigid inflexible reimageable imaging member surface to the smooth non-absorbent print substrate;

b') reclaiming dampening fluid vapor evaporated from the imaging member after transfer of the thinned layer of the patterned latent image of dampening fluid from the rigid inflexible reimageable imaging member surface to the smooth non-absorbent print substrate with a second vapor collection manifold adjacent the imaging roll downstream the first nip in the first direction; and c) applying ink from an inker subsystem located downstream of the imaging member in the media direction directly to the smooth non-absorbent print substrate having the thinned layer of the patterned latent image of dampening fluid disposed thereon, the ink adhering to portions of the smooth non-absorbent print substrate absent the dampening fluid solution resulting in an inked image on the smooth non-absorbent print substrate, the inker subsystem having an inker roll clear of contact with the imaging member, the applying including rotating the inker roll along a longitudinal axis thereof in the first direction to transfer the ink directly to the smooth non-absorbent print substrate.

11. The method of claim 10, further comprising:

d) applying a layer of dampening fluid to the rigid inflexible reimageable imaging member surface with a dampening fluid subsystem;

e) evaporating select portions of the dampening fluid layer with a patterning device by heating the rigid inflexible reimageable imaging member surface under the dampening fluid layer to produce the patterned latent image of the dampening fluid on the rigid inflexible reimageable imaging member surface.

12. The method of claim 11, the step c) including using an anilox inker roll with a rigid outer surface as the inker roll to meter the ink onto the smooth non-absorbent print substrate.

13. The method of claim 11, further comprising forwarding the inked smooth non-absorbent print substrate to one of a print station, a transport handling mechanism, an output tray, and a fixing apparatus.

14. The method of claim 11, further comprising, after step b) and before step d), providing a cleaned rigid inflexible reimageable image member surface without cleaning ink from the imaging member.

15. A variable data lithography system useful in printing, comprising:

an imaging member having a rigid inflexible reimageable imaging member surface configured to receive a patterned latent image of dampening fluid thereon;

a latent image transfer subsystem including the imaging member and a backer, the latent image transfer subsystem configured to split a thinned layer of the patterned latent image of dampening fluid from the patterned latent image of dampening fluid and transfer the thinned layer of the patterned latent image of dampening fluid from the rigid inflexible reimageable imaging member surface to the smooth non-absorbent print substrate at a first nip in a print substrate media direction within the latent image transfer subsystem, the imaging member having an imaging roll with the rigid inflexible reimageable imaging member surface, the imaging roll configured to rotate along a longitudinal axis thereof in a first direction to transfer the thinned layer of the patterned latent image from the rigid inflexible reimageable imaging member surface to the smooth non-absorbent print substrate;

an inker subsystem downstream of the imaging member in the media direction, the inker subsystem configured to apply ink from the inker subsystem directly to the smooth non-absorbent print substrate having the thinned layer of the patterned latent image of dampening fluid disposed thereon, the ink adhering to portions of the smooth non-absorbent print substrate absent the dampening fluid solution resulting in an inked image on the smooth non-absorbent print substrate, the inker subsystem having an inker roll clear of contact with the imaging member, the inker roll configured to rotate along a longitudinal axis thereof in the first direction to transfer the ink directly to the smooth non-absorbent print substrate;

a vapor removal apparatus including a first vapor collection manifold adjacent the imaging roll at a first side of the first nip upstream the first nip in the first direction and a second vapor collection manifold adjacent the imaging roll downstream the first nip in the first direction;

a processor; and a storage device coupled to the processor, wherein the storage device contains instructions operative on the processor for:

providing the patterned latent image of dampening fluid onto the rigid inflexible reimageable imaging member surface, removing dampening fluid vapor adjacent the rigid inflexible reimageable imaging member surface with the first vapor collection manifold, rotating the imaging roll along the longitudinal axis thereof in the first direction to split the thinned layer of the patterned latent image of dampening fluid from the patterned latent image of dampening fluid and transfer the thinned layer of the patterned latent image of dampening fluid from the rigid inflexible reimageable imaging member surface to the smooth non-absorbent print substrate, reclaiming dampening fluid vapor evaporated from the imaging member after transfer of the thinned layer of the patterned latent image of dampening fluid from the rigid inflexible reimageable imaging member surface to the smooth non-absorbent print substrate, and rotating the inker roll along the longitudinal axis thereof in the first direction to apply the ink from the inker subsystem directly to the smooth non-absorbent print substrate resulting in the inked image on the smooth non-absorbent print substrate.

16. The system of claim 15, further comprising:

a dampening fluid subsystem configured to apply a layer of dampening fluid to the rigid inflexible reimageable imaging member surface; and a patterning device configured to selectively evaporate portions of the dampening fluid layer by heating the rigid inflexible reimageable imaging member surface under the dampening fluid layer to produce the patterned latent image of the dampening fluid on the rigid inflexible reimageable imaging member surface.

17. The system of claim 16, wherein the smooth non-absorbent print substrate has a first side and a second side, the first side receiving the thinned layer of the patterned latent image of dampening fluid from the imaging member and the ink from the inker subsystem, both the imaging member and the inker substation being in fluid communication with the first side of the smooth non-absorbent print substrate.

18. The system of claim 15, the vapor removal apparatus further including a third vapor collection manifold downstream of the inker subsystem, the third vapor collection manifold configured to reclaim dampening fluid from the smooth non-absorbent print substrate through evaporation.

19. The system of claim 15, wherein the inker roll is an anilox inker roll having a rigid outer surface, the anilox inker roll configured to meter the ink directly onto the smooth non-absorbent print substrate, and the inker subsystem includes a backer in communication with the second side of the smooth non-absorbent print substrate opposite the anilox inker roll.

* * * * *